United States Patent [19]

Raasch et al.

[11] Patent Number: 4,541,233

[45] Date of Patent: Sep. 17, 1985

[54] METHOD AND DEVICE FOR STARTING THE OPERATION OF A FRICTION-SPINNING MACHINE UNIT

[75] Inventors: Hans Raasch; Heinz-Georg Wassenhoven; Josef Derichs, all of Monchen-Gladbach, Fed. Rep. of Germany

[73] Assignee: W. Schlafhorst & Co., Monchen-Gladbach, Fed. Rep. of Germany

[21] Appl. No.: 609,774

[22] Filed: May 14, 1984

[30] Foreign Application Priority Data

May 13, 1983 [DE] Fed. Rep. of Germany ..... 3317361

[51] Int. Cl.[4] ..... D01H 15/02

[52] U.S. Cl. ..... 57/263; 57/22; 57/401

[58] Field of Search ..... 57/22, 261, 263, 279, 57/280, 300, 301, 304, 305, 400, 401, 332, 334, 335, 337, 338, 348, 352, 353

[56] References Cited

U.S. PATENT DOCUMENTS

| | | | |
|---|---|---|---|
| 4,168,601 | 9/1979 | Didek et al. | 57/401 |
| 4,315,398 | 2/1982 | Parker et al. | 57/401 |
| 4,327,545 | 5/1982 | Fehrer | 57/401 X |
| 4,334,400 | 6/1982 | Fehrer | 57/401 X |
| 4,367,623 | 1/1983 | Parker et al. | 57/263 |
| 4,399,650 | 8/1983 | Parker et al. | 57/401 |

*Primary Examiner*—Donald Watkins

*Attorney, Agent, or Firm*—Herbert L. Lerner; Laurence A. Greenberg

[57] ABSTRACT

A method of starting the operation of a friction spinning unit having friction surfaces displaceable in opposite directions and forming a spinning wedge, the spinning unit further having a fiber infeeding device, a thread take-up device for drawing a thread longitudinally through the spinning wedge, and at least one suction device acting upon the spinning wedge, at least one of the friction surfaces being formed by a sieve drum, the suction device having a suction nozzle acting upon the spinning wedge by sucking air through the wall of the sieve drum includes:

(a) stopping the fiber infeed, and stopping the displacement of the friction surfaces;

(b) stopping the flow of suction air from the spinning wedge through the wall of the sieve drum into the suction nozzle;

(c) introducing into the spinning wedge through the wall of the sieve drum a suction air flow in a direction opposing the direction in which the thread is being drawn, and guiding the air flow out of the suction nozzle through the wall of the sieve drum and in a direction opposing the direction in which the thread is being drawn, along the spinning wedge, and out of the spinning wedge;

(d) after a given effective duration of the suction air flow, introducing a thread end into the spinning wedge in a direction opposing normal thread drawing direction;

(e) again applying a suction air flow from the interior of the spinning wedge through the wall of the sieve drum into the suction nozzle;

(f) restarting the fiber infeed, and displacing the friction surfaces with increasing speed in opposing directions;

(g) resuming the thread drawing, and increasing the thread drawing until normal spinning conditions are reached; and (h) at the latest at this juncture, again stopping the suction air flow directed against the thread drawing direction; and device for performing the method.

25 Claims, 8 Drawing Figures

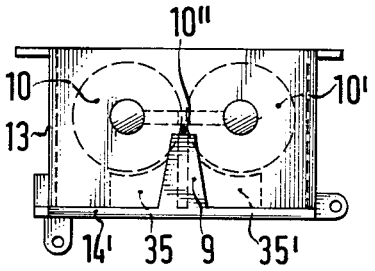
FIG. 4
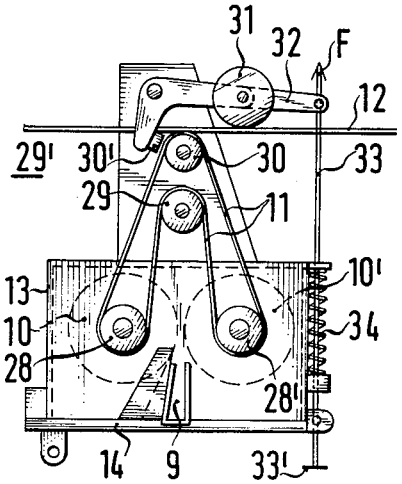
FIG. 3
FIG. 7
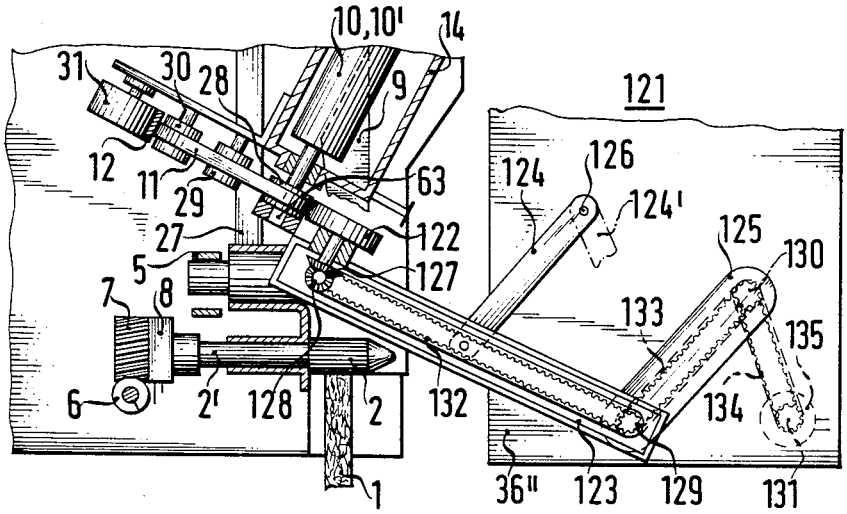

METHOD AND DEVICE FOR STARTING THE OPERATION OF A FRICTION-SPINNING MACHINE UNIT

The invention relates to a method and a device for starting the operation of a friction spinning unit having friction surfaces displaceable in opposite directions and forming a spinning wedge or nip, the spinning unit further having a fiber infeeding device, a thread take-up or drawing device for drawing a thread longitudinally through the spinning wedge, and at least one suction device acting upon the spinning wedge, at least one of the friction surfaces being formed by a sieve-drum, the suction device having a suction nozzle acting upon the spinning wedge by sucking air through the wall of the sieve drum, especially for rectifying or removing a thread break. The other friction surface can also be formed by a similar sieve drum. If both sieve drums are rotated in the same rotating direction, the friction surfaces at the spinning wedge or nip move in opposite directions.

If the second friction surface also is formed by a sieve drum, the latter also has a suction device with a suction nozzle sucking air through the wall of the sieve drum, and acting upon the spinning wedge or nip. The entire suction device is then subdivided into two suction arms.

The second friction surface may also have a quite different construction, however, and may, for example, be formed of a simple drum, or be constructed essentially of a moving belt.

Friction spinning units of this general type are used for automated spinning operations. Several friction spinning units can be combined to form a friction spinning machine. The friction spinning units can be constructed with individual drive motors, or they may be provided with common drives.

Heretofore, friction spinning units of this general type were started up manually. Also, broken threads were rectified i.e. joined, by hand, and the quality of the required thread joint depends upon the manual dexterity of the operator. Consequently, the quality of the thread connection or joint varies, and is left to chance.

The invention has as its basic objective the provision of a method and device which affords a completely automatic starting of the operation of a friction spinning unit, especially to correct or remove thread breaks.

With the foregoing and other objects in view, there is provided, in accordance with the invention, a method of starting the operation of a friction spinning unit having friction surfaces displaceable in opposite directions and forming a spinning wedge, the spinning unit further having a fiber infeeding device, a thread take-up device for drawing a thread longitudinally through the spinning wedge, and at least one suction device acting upon the spinning wedge, at least one of the friction surfaces being formed by a sieve drum, the suction device having a suction nozzle acting upon the spinning wedge by sucking air through the wall of the sieve drum, which comprises: stopping the fiber infeed, and stopping the displacement of the friction surfaces; stopping the flow of suction air from the spinning wedge through the wall of the sieve drum into the suction nozzle; introducing into the spinning wedge through the wall of the sieve drum a suction air flow in a direction opposing the direction in which the thread is being drawn, and guiding the air flow out of the suction nozzle through the wall of the sieve drum and in a direction opposing the direction in which the thread is being drawn, along the spinning wedge, and out of the spinning wedge; after a given effective duration of the suction air flow, introducing a thread end into the spinning wedge in a direction opposing normal thread drawing direction; again applying a suction air flow from the interior of the spinning wedge through the wall of the sieve drum into the suction nozzle; restarting the fiber infeed, and displacing the friction surfaces with increasing speed in opposing directions; resuming the thread drawing, and increasing the thread drawing until normal spinning conditions are reached; and at the latest at this juncture, again stopping the suction air flow directed against the thread drawing direction.

Advantages obtained by the invention lie especially in that start-up or rectifying of thread breaks is effected completely automatically, rapidly and reliably. Accidental errors due to manual operation do not occur, and the thread connection or joint has a high and uniform quality.

In order to start the operation according to the invention, the fiber infeed is stopped, and movement of the friction surfaces is stopped; the flow of suction air directed from the spinning or nip wedge through the wall of the sieve drum into the suction nozzle is also stopped; and a suction air flow in a direction opposite the direction in which the thread is drawn is introduced into the spinning wedge, the air flow then being directed out of the suction nozzle, through the wall on the sieve drum, and opposite the thread drawing direction, along the spinning wedge, and out of the spinning wedge; after a given effective duration of the suction air flow, a thread end is introduced into the spinning wedge in a direction opposite the normal thread drawing direction; the suction air flow directed from the interior of the spinning wedge through the wall of the sieve-drum is resumed, the fiber infeed is started again, and the friction surfaces are accordingly moved with increasing speed in opposite directions, and the thread drawing is started and increased until normal spinning conditions are reached, the suction air flow directed opposite the thread drawing direction being stopped again at the latest at this point of the operation.

In practice and, in accordance with another mode of the invention, the direction of the air flowing through the wall of the sieve drum is reversed after the suction air flow has been stopped and, after the thread drawing has started, the fiber infeed, the movement of the friction surfaces and the thread drawing rate are coordinated with one another and increased until normal spinning conditions are reached.

In accordance with a further mode, the method includes, after inserting the thread into the spinning wedge, displacing the friction surfaces in a direction opposing the direction used during the normal spinning operation, in order to remove thread twist from the thread end.

In accordance with a further mode, the method includes holding the thread fixed outside of the spinning wedge at least as long as necessary to remove the twist from the thread end.

In accordance with an added mode, the method includes shutting off the suction nozzle from its air supply, and venting the suction nozzle to the surrounding air, or connecting it to a source of compressed air, in order to provide air flow through the wall of the sieve drum in a direction opposite to the direction in which the thread is drawn along the spinning wedge and out of the spinning wedge.

In accordance with another aspect of the invention, there is provided, a device for performing a method of starting the operation of a friction spinning unit having friction surfaces displaceable in opposing directions and forming a spinning wedge, the spinning unit further having a fiber device, a thread take-up device for drawing the thread longitudinally through the spinning wedge, and at least one suction device acting upon the spinning wedge, at least one of the friction surfaces being formed by a sieve drum, the suction device having a suction nozzle acting upon the spinning wedge by sucking air through the wall of the sieve drum, comprising a pneumatic device having means for generating an air flow and for directing the air flow along the spinning wedge opposite the thread drawing direction, and out of the spinning wedge.

In accordance with another feature of the inventive device, the one suction device and the pneumatic device have a common blocking device for alternatively providing suction air to the one suction device and the pneumatic device and for preventing simultaneous application of suction air to the one suction device and the pneumatic device.

In accordance with a further feature of the invention, the device includes a blocking device constructed as a switchable directional valve, which is alternatively switchable for connecting the one suction device and the pneumatic device, respectively, to a common source of suction air and/or surrounding air, and/or a compressed air source.

In accordance with an additional feature of the invention, the sieve-drums with the friction surfaces are movable parts of the friction spinning unit forming the spinning wedge, and are provided with a cover having air suction means of a thread joining suction device located at a side opposite the thread drawing side.

In accordance with an added feature of the invention, the air suction means are disposed at a fiber supply channel of the fiber infeed device, the fiber supply channel extending through the cover.

In accordance with yet another feature of the invention, the device includes a program-controlled automatic thread joining device operatively combined with the friction spinning unit.

In accordance with yet a further feature of the invention, the automatic thread joining device is constructed as a movable device for servicing a plurality of friction spinning units of a friction spinning machine sequentially.

In accordance with yet additional features of the invention the automatic thread joining device comprises: means for driving the take-up coil in a direction opposing thread winding direction and in the direction of winding of the thread; means for sucking-in the thread movable towards the surface of the take-up coil, and back again; means for making-ready a thread end taken from the take-up coil for the thread joining operation; means for transporting the made-ready thread end to a thread suction location within working range of the thread joining suction device; means for disabling and re-enabling the thread drawing device of the friction spinning unit; means for actuating the blocking means, and the directional valve, respectively, of the one suction device and the pneumatic device; means for starting the operation of the sieve drums of the friction spinning unit forming the friction surfaces; means for controlling the fiber infeed device during the thread joining operation; and means for returning the joined thread to the friction spinning unit, and into the normal spinning position.

In accordance with another feature of the invention, the automatic thread joining device has means for controlling the sieve drums of the friction spinning unit during the joining operation.

In accordance with a further feature of the invention, the automatic thread joining device has a grinding device for readying and sharpening the end of the thread.

In accordance with additional features of the invention, the friction spinning unit is provided with a shut-off device cooperatively associated with a thread monitor or thread cleaner, for stopping fiber infeed and rotation of the take-up coil, and/or is provided with means cooperatively associated with the thread monitor or thread cleaner for stopping the sieve drums forming the friction surfaces.

In accordance with an added feature of the invention, the device includes means for controlling the sieve drums forming the friction surfaces, the controlling means being constructed so as to drive the sieve drums alternatively in forward and reverse direction.

In accordance with yet another feature of the invention, the friction spinning unit or the thread joining device have means for holding the thread in a fixed position outside the spinning wedge during the time when the thread twist is removed from the thread end.

In accordance with a concomitant feature of the invention, the pneumatic device is a thread-joining device.

Other features which are considered as characteristic for the invention are set forth in the appended claims.

Although the invention is illustrated and described herein as embodied in a method and device for starting the operation of a friction-spinning machine unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a bottom plan view of the sieve drums showing details of the drive arrangement therefor;

FIG. 4 is a top plan view of the sieve drums showing details of the surrounding covering thereof;

FIG. 7 is an enlarged fragmentary view of FIG. 5 showing a friction spinning unit corresponding approximately to the unit shown in FIG. 5, together with a travelling automatic thread-joining device having a different construction from that of FIG. 5.

Figure 1:
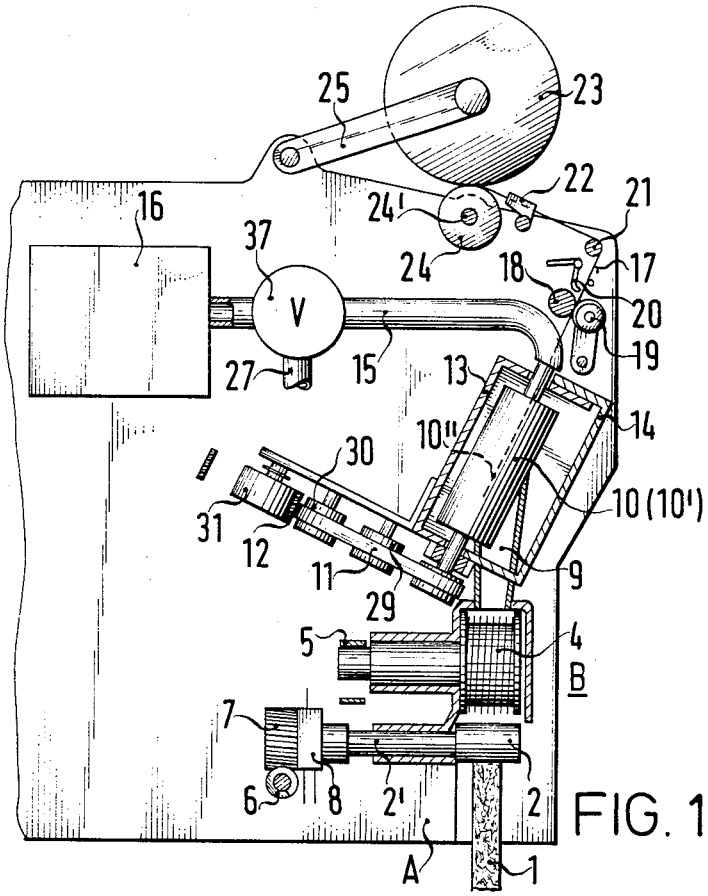
FIG. 1 is a diagrammatic vertical sectional view of a friction spinning unit.

Referring now to the drawings and, first, particularly, to FIGS. 1 to 6 thereof, there is shown therein a first specific embodiment of the invention which is further described and explained hereinafter.

Figure 5:
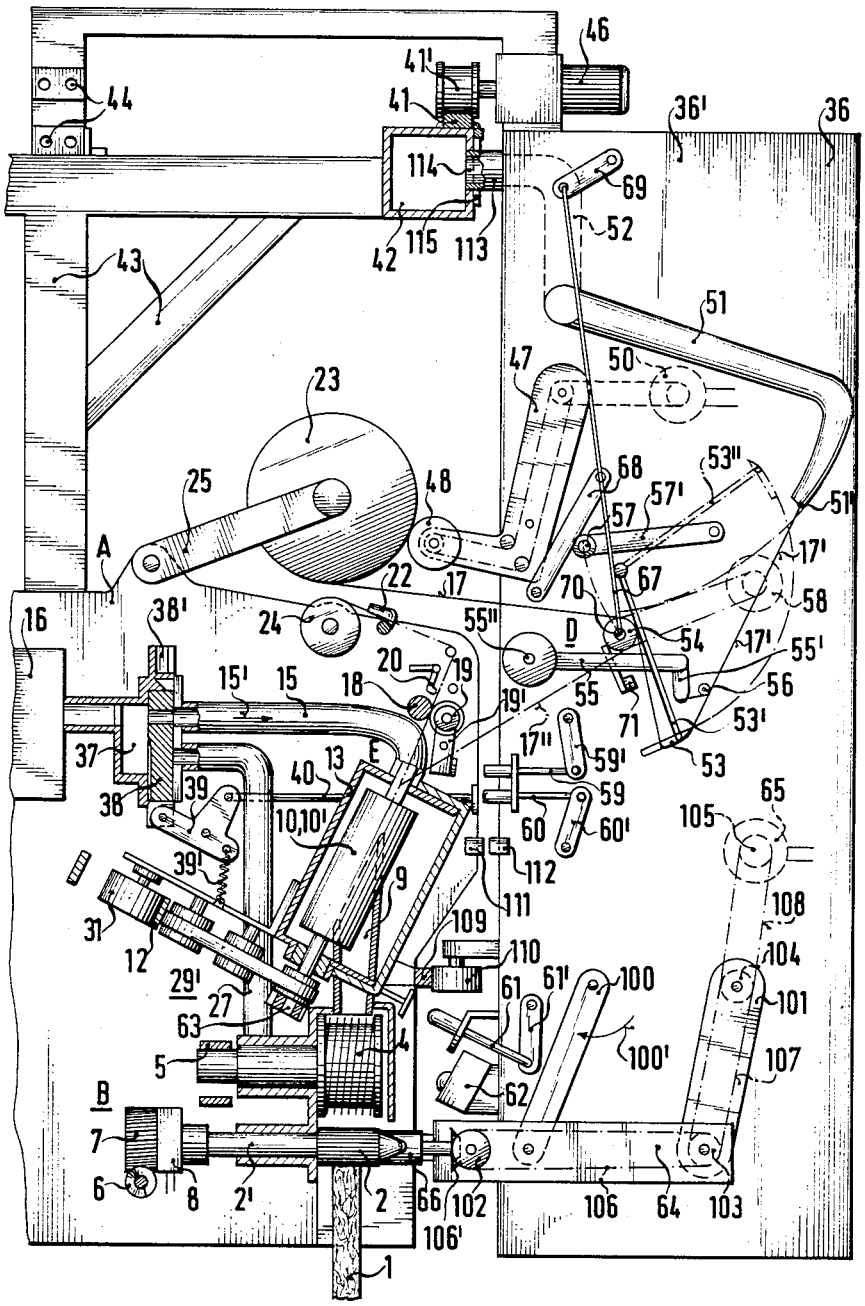
FIG. 5 is a diagrammatic vertical sectional view of a friction spinning unit corresponding approximately to the unit according to FIG. 1, cooperatively assembled with a travelling automatic thread joining or piecing device.

A friction spinning unit is shown in FIG. 1 and in FIG. 5 which is one of a number of individual friction spinning units usually combined to form a friction spinning machine. The individual parts of the friction spinning unit are generally held together by a machine frame A. A fiber sliver is supplied via a drawing-in or feed roller 2 and a clamping plate 3 (shown in FIG. 2) to a loosening or disentangling roller 4 which is provided with needles or a set of saw teeth. The loosening roller 4 rotates at a high peripheral velocity and loosens or separates the fiber sliver 1 into individual fibers.

The drawing-in roller 2 is driven by a worm shaft 6 extending along the length of the friction spinning machine. A worm gear 7 which engages the worm shaft 6 is connected by an electro-magnetic clutch 8 to a shaft 2' carrying the drawing-in roller 2.

The dissolved or disentangled fibers are conducted through a fiber channel 9 into the spinning wedge or nip 10" formed by two sieve drums 10 and 10'. The parts 2 to 9 together form a fiber feeding device which is identified in its entirety by the reference character B.

FIG. 3 shows especially that the sieve drums 10 and 10' are driven by a belt 11 in the same rotary direction. The belt 11 is, in turn, driven by a tangential belt 12 which extends along the entire length of the friction spinning machine. The sieve drums 10 and 10' are disposed in a housing 13, which is closed in front by an outwardly swingable, hinged cover 14.

Figure 2:
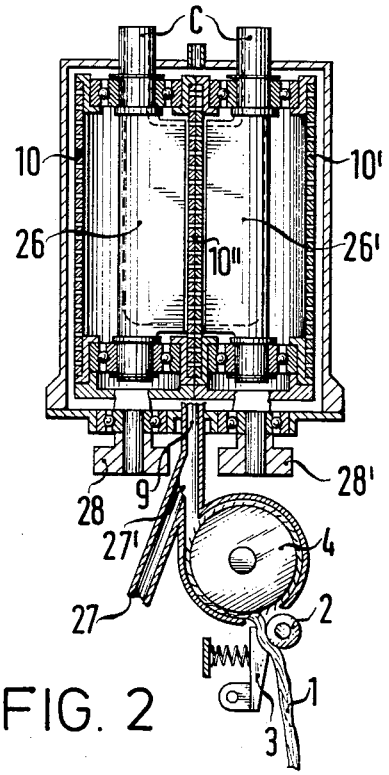
FIG. 2 is an enlarged fragmentary view of FIG. 1 showing a fiber lead-in device and sieve-drums of the friction spinning unit in a sectional plane transverse to that of FIG. 1.

In particular, FIG. 2 shows that the friction spinning unit is provided with a first suction device C, which is forklike and terminates at two suction nozzles 26 and 26', of which the suction nozzle 26 is disposed within the sieve drum 10, and the suction nozzle 26' within the sieve drum 10'. The two suction nozzles 26 and 26' are almost as long as the spinning wedge or nip 10" and extend outwardly from the interior of the respective sieve drums 10 and 10' until the nozzle openings thereof are located so closely to the wall of the respective sieve drum that they apply air suction through the wall of the respective sieve drum onto the spinning wedge or nip 10", the instant negative pressure is produced at the suction nozzles 26 and 26' from a channel 16 via a controllable directional valve 37 and a pipeline 15.

FIG. 1 shows the friction spinning unit during the undisturbed lapping or winding operation. The thread 17 formed in the spinning wedge or nip 10" is drawn-off at constant velocity by a take-up shaft 18 which extends along the entire friction spinning machine and by a take-up roller 19 which is spring-biased against the take-up shaft 18. The thread 17 travels past a thread monitor 20 which can assume several control functions. For example, if the thread breaks, the thread monitor 20 acts upon the electro-magnetic clutch 8 which serves as a stopping or knocking-off device for the fiber supply, and brings the feed roller 2 to a halt. Furthermore, if the thread breaks the monitor 20 can activate a non-illustrated device which lifts up a coil frame 25 for a take-up coil 23 so that the take-up coil 23 becomes disengaged from a winding-roller 24. The thread monitor 20 can also have other indicating and switching or control functions. For example, it can release a signal which causes a thread joining device which is travelling past, to correct the thread-break.

After the thread monitor 20, the thread 17 passes over a diagonal-pull equalizing bar or wire 21, then runs through a reciprocating thread guide 22 and is wound onto the take-up coil 23 forming a crosswound bobbin or cheese. For this purpose, the take-up coil 23 rolls on the rotating winding roller 24, which has a shaft 24' extending along the entire friction spinning machine.

It is apparent from FIG. 1 that the fiber channel 9 is directed against the sieve-drum 10 and 10' in such a manner that it feeds the fibers nearly axially into the spinning wedge or nip 10".

As shown in FIGS. 2 and 5, the friction spinning unit is provided with a joining suction device 27 furnished with means for producing an air flow directed opposite to the direction in which the thread is drawn off and flowing along the spinning wedge or nip 10" and out of the latter. An air suction orifice 27' is located at the fiber supply channel 9 which projects through the cover 14. From FIGS. 2 and 5, it is apparent, that the suction device 27 is tubular, and terminates at a directional valve 37. The joining suction device 27 has, as its function, the sucking of fibers and remaining threads from the spinning wedge or nip 10" and from the sieve drums before the start of the joining or piecing operation and, thereafter, to suck into the spinning wedge or nip 10" the end of one of the threads that are to be joined.

The illustrated arrangement of the joining suction device 27 is only by way of example. The course or path thereof may also extend parallel to the fiber supply channel 9 or parallel to the spinning wedge 10". What is of importance, in this regard, is that the direction of flow be opposed to the direction in which the thread is drawn off.

The automatic thread joining device 36 shown in FIG. 5 is constructed as a device which is capable of travelling and which services all of the friction spinning units of the friction spinning machine in sequence, i.e. successively. It is able to travel by means of rollers 41' on a rail 41 which is fastened onto an air suction channel 42. With this air suction channel 42 the thread joining device 36 is able to be attached to an air suction source independently of the respective place of use thereof. The air suction channel 42 is braced against the frame A by a support structure 43. Energy supply lines 44, for example, lines which supply electrical energy and, if necessary or desirable, compressed air to the thread joining device 36, are located in hollow spaces formed in the support structure 43. One of the two rollers 41' provided, only one of which is illustrated, is driven by a motor 46.

The thread joining device 36 has a mechanism 47 for driving the take-up coil 23 in the direction in which the thread is being wound and also opposite the direction in which the thread is being wound. The mechanism 47 is formed of a pivotal coil-drive arm carrying a drive roller 48 which is operatively connected to a coil-drive motor 50. The instant the drive roller 48 engages the take-up coil 23, the latter is caused to revolve by friction, either in the direction in which the thread is wound, or in opposite direction thereto, depending upon the rotational direction of the coil-drive motor 50.

The thread joining device 36 also has a suction device 51 in the form of a pivotal suction nozzle which is movable into engagement with the surface or into proximity of the surface of the take-up coil 23 and back again. This suction device 51 is connected to the air suction channel 42 with a line 52. A conventional mechanism disposed in the housing 36' can swing the suction device 51 towards the take-up coil 23 and back again. The instant the drive roller 48 turns the coil 23 in the direction opposite to the winding direction of the thread, the thread suction device 51 swings forward, and applies suction to the surface of the coil 23. The purpose of this measure is to find the thread ending and to suck it in. After a predetermined suction-time has elapsed, the suction device 51 swings back into the position thereof shown in FIG. 5 and at this instant, a device for making-ready the thread end taken from the coil 23 for the thread joining operation and identified as a whole by reference character D begins to operate.

The device D includes a thread insertion device 53 in the form of a thread gripper which sits on a pivotal lever 53'. The lever 53' is movable into the position 53'' and back again by means of a programmed mechanism disposed in the housing 36'. As it moves back, the insertion device 53 forms a thread loop 17' which extends from the mouth 51' of the suction device 53, and from the latter to a stationary delivery roller 54. As the insertion device 53 swings back to the position 53'' thereof, the thread loop 17' is so positioned that it lies in grippers 55' of a pivoted thread carrier or delivering arm 55, and engages a grinding disc 56 which is mounted on this carrier 55.

The thread carrier 55 serves as a device for bringing the made-ready thread end into a region E located within the working range of the suction device 27 whereat the thread can be sucked into the suction device 27. The delivery roller 54 operates in conjunction with a drawing roller 57 which is supported on a pivotable arm 57'. FIG. 5 shows that the thread withdrawn from the take-up roller 23 is first clamped between the delivery roller 54 and the drawing roller 57, the arm 57' being swung or pivoted downwardly by means of a program-controlled mechanism disposed in the housing 36'. The delivery roller 54, which later takes over provisional thread draw-off, is connected to a motor 58. Initially, however, the thread loop 17 is in contact with the grinding disc 56, which severs the thread loop and, due to the grinding, so unravels the fibers of the newly created thread-end which is still clamped in the grippers 55' that, when the joining operation is started later, the thread becomes securely connected with the newly supplied fibers.

When, thereafter, the thread carrier 55 swings downwardly about the pivot 55'' thereof, due to this pivoting movement, it brings the thread end made-ready for the joining operation into the thread pickup or sucking-in position E, which is located in front of the draw-off opening of the housing 13. In the interim, due to the joining suction device 27, negative pressure is produced in the housing 13, so that at the position E in front of the housing opening, a very strong suction effect is maintained which sucks in the thread-end as soon as the grippers 55' of the thread carrier 55 open. The opening of the grippers 55' is effected by suitable stops which are contacted by the clamps 55''.

The thread joining device 36, furthermore, has a device 59 for taking the thread take-up device 18 and 19 of the friction spinning unit out of operation and for switching it on again. The device 59 is formed of a plunger or tappet which, by means of a lever 59', can be pressed against a lever 19' which carries the take-up roller 19. The take-up roller 19 is thereby lifted away from the take-up shaft 18, so that the thread take-up device of the friction spinning unit is ineffective or inactivated. The lifting of the take-up roller 19 away from the take-up shaft 18 is necessary in order to bring the previously joined thread back from the thread-joining device 36 to the friction spinning unit, which can thereafter again resume the taking-up of the thread after the take-up roller 19 is again brought into contact with the take-up shaft 18.

The thread joining device 36, furthermore, has a device 60 for operating the directional valve 37. The device 60 is formed of a plunger or tappet which can be moved forward by a lever 60'. A pressure rod 40 is thereby moved forward and acts upon an angular lever or bellcrank 39 which is itself connected to a slider 38 of the directional valve 37 which controls the valve settings. If the plunger or tappet 60 is withdrawn again, the slider 38 is restored or set back to an original position thereof by a restoring or return spring 39'. The thread joining device, additionally, has a device 61 for starting-up the movable parts forming the friction surfaces of the friction spinning unit i.e. the sieve drums 10 and 10', in this case. The device 61 is formed as a plunger or tappet which, as especially shown in FIG. 3, can be pressed against a plate 33' carried by a rod 33, which articulates with a pivotal lever 32. The lever 32 carries a pressure roller 31, which thereby can be lifted from the tangential belt 12, so that the tangential belt 12 loses the contact thereof with the rear side of the belt 11. At the same time, a brake shoe 30' adjacent the belt 11 presses onto the roller 30, which is mentioned again hereinafter, and thereby brakes the drive of the sleeve drums. This could also have been initiated previously by a thread monitor 20, which actuates a device F for stopping the movable friction elements, as indicated in FIG. 3 by an arrow. In any case, as the thread joining device 36 begins to operate, the plunger or tappet 61 is moved forwardly and the reaction or signal of the thread monitor 20 is canceled or cleared. To start the sieve drums again, the plunger 61 is again withdrawn by the lever 61'. This also occurs after the thread joining program as will be explained hereinafter.

The thread joining device 36 also has a device 62 for controlling the drive of the friction drums 10 and 10'. The device 62 is formed of a reflection light barrier upon which a reflector 63 acts, which is connected to the shaft of the sieve drum 10. A signal can therefore be obtained at the electrical output of the reflection light barrier 62, which is proportional to the rotational speed. This signal can be used, in turn, for controlling the lever 61', so that, for example, the braking of the sieve drums can occur corresponding to a defined frequency proportional to the rotational speed.

The thread joining device has a further device 64 for controlling the fiber supply device B during the thread joining operation. The device 64 is formed of an arm swingably suspended on pivotal levers 100 and 101 and connected by gears 102 to 105 and a toothed belt 106, 107 and 108 to a motor 65 having a controllable rotational speed. The gear 102 is operatively connected via a bevel gear transmission 106' to a slip-on clutch 66 which, as shown, in FIG. 5 is actually slipped onto the end of the shaft 2' of the drawing-in roller 2.

The thread joining device 36 also has a device 67 for returning or guiding the joined thread back to the friction spinning unit and into the normal spinning position. The device 67 is formed of a rod which is articulatingly suspended from two pivotally supported levers 68 and 69. It carries a transfer roller 70. Due to the particular suspension of the device 67, the transfer roller 70 is guided so that the thread-loop 17", which forms between the take-up coil 23 and the friction spinning unit after the start of the spinning operation, is deposited from the delivery roller 54 by a pivotal throw-off element 71 onto the transfer roller 70, and is then guided so that the thread becomes positioned behind the take-up roller 19 and passes into the thread guide 22 of the friction spinning unit.

It is also apparent from FIG. 5 that, along the length of the friction spinning machine, a support rail 109 is provided, against which bracing or supporting rollers 110 of the thread joining device 36 are braced.

To cause the thread joining device 36 to stop at a certain friction spinning unit in order to remove a thread break thereat, a signal generator 111 operatively connected with the thread monitor 20 is provided at each friction spinning unit, and this signal acts upon or is transmitted to the signal receiver 112 of the thread joining device 36. The signal receiver 112 causes the thread joining device 36 to stop, and to indicate the predetermined thread joining program, which will be discussed hereinafter.

When the joining device 36 moves into the operating position thereof, a coupling member 113 located a the end of pipe line 52 pushes aside a pivotally or hingeably mounted lid 115 disposed in front of the opening 114 of the suction channel 42 and, in this manner, establishes the connection of the suction nozzle 51 with the air-suction channel 42.

The two sieve drums 10 and 10' are supported to run as synchronously as possible, especially when the sieve drums start to revolve again at the occurrence of the automatic thread joining operation, and if the friction spinning unit is set into operation, respectively. However, it may be sometimes desirable to let one sieve drum revolve somewhat faster than the other, in order to influence the retention of the thread in the wedge or nip region. The difference in rotational speed is then very small, however, and must also be accurately maintained. This is assured by the drive arrangement 29' for driving the sieve drums 10 and 10', especially as shown in FIG. 3. In FIG. 3, a belt 11 is shown wrapped about 180° around the pulleys 28 and 284' so that good entrainment of the pulleys is attained.

The belt 11 runs over rollers 29 and 30, the roller 29 being adjustable and serving as a tension roller. The roller 30 is stationary and serves as a drive roller. A tangential belt 12 running along the length of the whole friction spinning machine is pressed against the rear side of the belt 11 by a pressure roller 31.

In certain applications, a variation or modification in the construction of the housing, as shown in FIG. 4, may be of advantage. In FIG. 4, the wedge or nip region 10" of the two sieve drums 10 and 10' is especially covered, in fact, by two cover segments 35 and 35' which are connected to the hinged cover 14'. By using such cover segments, the air suction guidance can be concentrated better onto the spinning wedge or nip 10".

According to FIG. 5, the slider 38 of the directional valve 37 is so positioned that the suction device C (FIG. 2) is connected by its pipeline 15 to the channel 16. If the slider 38 is moved downwardly, the suction device 27 is connected to the channel 16 instead and, at the same time, the pipeline 15 is connected to the outside surrounding air through the pipe nozzle 38'. In a different construction, the pipe 38' could be connected instead to a compressed air source. In such a case, compressed air would flow through the line 15 in direction of the arrow 15' for the purpose of cleaning the sieve drums and the spinning wedge or nip.

Figure 6:
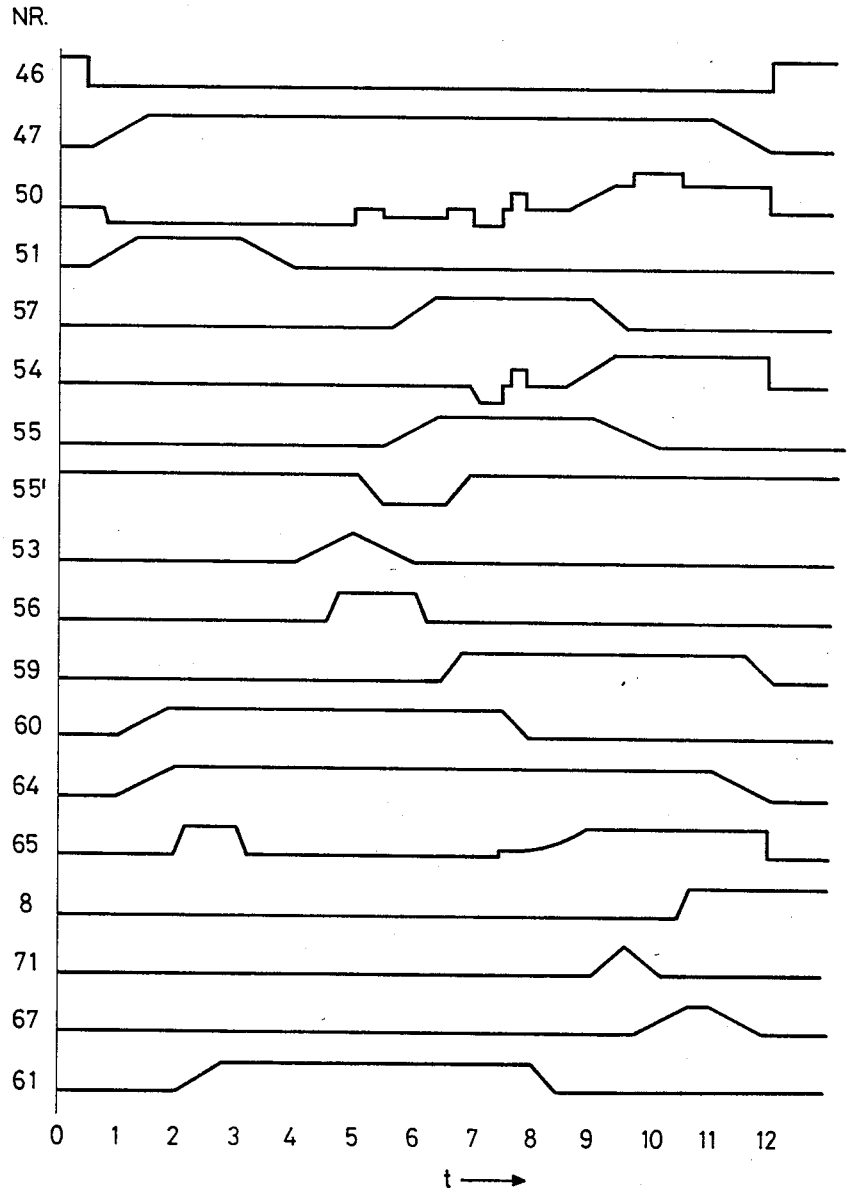
FIG. 6 is a motion diagram depicting the operation of the automatic thread joining device of FIG. 5.

The start-up of the friction spinning unit will now be explained with the aid of the motion diagram shown in FIG. 6.

When the thread joining device 36 arrives at a friction spinning unit having a thread monitor 20 signalling a thread break, the signal generator 111 transmits the thread break signal to the signal receiver 112 of the thread joining device 36. A joining program is then initiated, at the beginning of which, at the time 0.5, the motor 46 of the travel mechanism is switched off. This is a prerequisite for the thread joining device to be in the joining position. At the same time, the device 47 is started which, at the time 1.5 moves the drive roller 48 against or into contact ith the take-up coil Z3. Also, at the time 0.5, the thread suction device 51 is started, the suction nozzle 51' of which is in the vicinity of the surface of the coil 23 at the time 1.5. The coil drive motor 50 rotates in the reverse direction at a speed suitable for searching for the thread end. The motor 50 is switched on at the time 0.8. At the time 1.0, the device 60 for operating the directional valve 37 is switched on. The switching-over of the valve 37 is terminated at the time 2. As an alternative thereto, the directional valve can be switched over even prior to the arrival of the thread joining device 36, as previously mentioned hereinbefore. At the instant of time 1.0, the device 64 for controlling the fiber feeding device B is set into operation. This is effected by swinging the lever 100 in the direction of the curved arrow 100', as shown in FIG. 5, until the slip-on clutch 66 is in contact with the end of shaft 2'. The clutching operation is terminated at the time 2.

Accordingly, at the time 2, the device 47 is in operation so as to revolve the coil 23 in a direction opposite to the direction in which the thread is wound up thereon. At the same time, the thread-suction device 51 is in operation to seek out and suck up the end of the thread on the surface of the take-up coil 23. The device 60 has switched over the directional valve 37, so that also the joining suction device 27 is in operation, and the two sieve drums 10 and 10' and the wedge or nip region are purged or cleansed of remainders of threads and fibers. At the same instant of time 2, the motor 65 is switched on, and at the time 3 switched off again. Because the loosening roller 4 continues to rotate, for a brief interval of time, fibers are fed through the fiber supply or feed channel 9 into the spinning wedge 10". The fibers have no place to accumulate, however, and are again removed by the joining suction device 27. This brief .infeed of fibers has the purpose only of forming a whisker-like fiber accumulation, in a specific combed-out state, at the outlet of drawing-in roller 2. The subsequent joining operation is thereby facilitated and improved. At the latest, at the time instant 2, the rotation of the sieve drums is stopped by actuating the device 61. This could also have been effected earlier by the thread monitor 20.

At the time 3, the thread suction device 51 is again swung back to the starting position thereof shown in FIG. 5. The swinging movement is concluded at the time 4. The end of the thread is then located in the suction nozzle orifice 51'. At the time 4, the device D for making the thread end ready is started, the insertion device 53 being swung from position 53" thereof into the position thereof shown in FIG. 5. The swinging movement is terminated at the time 5. The insertion device 53 entrains the thread loop 17', inserts the thread into the grippers 55' of the thread carrier 55 and, simultaneously, Ebrings the thread into contact with the grinding stone 56. At the instant of time 5.0, the grippers 55 are closed in order to grip the thread. At the time 6.5, the grippers 55 are opened again. The grinding stone 56 is switched on already, namely at the time 4.5, and is switched off again at the time 6. The grinding stone 56 has its own drive motor which is not shown, however, in FIG. 5 of the drawing. The grinding stone 56 severs the thread, and prepares the new thread end by grinding, for the subsequent joining operation. The coil drive motor 50 is switched off at the time 5. At the same time, the thread insertion device 53 is returned to position 53" thereof. It has reached this position again at the time 6. The thread carrier 55, the grippers 55' of which have received the thread, is started at the time 5.5. Simultaneously, the coil drive motor 50 is also turned on again, in order to supply the length of thread required for the swinging movement of the thread carrier 55. The thread carrier 55 swings into the thread suction region E, which it reaches at the instant of time 6.5. At the time 5.5, the drawing roller 57 is also pressed against the delivery roller 54 by the swing of the arm 57'. In this regard, the thread is clamped between the drawing roller 57 and the delivery roller 54. At the time instant 6.5, the device 59 is activated in order to disable or render inoperative the thread take-up device 18, 19 of the friction spinning unit. The take-up roller 19 thus lifts itself up from the take-up shaft 18. The coil drive motor 50 keeps running until the instant of time 6.5, and is then switched off. It is again switched on at time instant 7, and switched off anew at the time 7.5. Because the grippers 55' of the thread carrier 55 open at the time 6.5, the thread end can be sucked-in between the sieve drums and down into the suction device 27. The reverse-running coil drive motor 50 supplies the length of thread required for this purpose.

At the instant of time 7, the delivery roller 54 is switched on for return delivery of the thread by activating the draw-off motor 58 until the instant 7.5. The same applies for the coil drive motor 50. Thereafter, the delivery roller 54 and the coil drive motor 50 are switched on briefly to draw-off the thread from the coil, so that the thread end which initially reached to the thread suction device 27, is then drawn back so far that it lies in the spinning wedge or nip 10", ready for the joining operation. At the time 7.5, the device 60 is reset, whereby the directional valve 37 is switched over. The suction device C is thereby activated, and the joining suction device 27 is switched off. At the instant of time 7.5, the infeed of fibers is started by switching on the motor 65. The run-up of the fiber infeed to the rated speed lasts until the time instant 9. At the time 8, the device 61 releases the drive of the sieve drums, which has a run-up time to rated speed which is coordinated with the corresponding run-up time of the motors 65 and 58, so that also at the joining operation, twist and draft or stretch of the thread correspond to prescribed values.

The run-up after the thread joining has occurred is terminated approximately at the instant of time 9. The run-up is controlled by the signals of the reflection light barrier or gate 62.

After all of the drives have reached the operational rotary speeds thereof, the throw-off device 71 is actuated at the time 9, and is returned again at the time 10 to the starting position thereof.

The throw-off device 71 throws off the thread loop 17 from the delivery roller 54. Prior to this, at the instant 8.5, the delivery roller 54 was made ready to draw-off the thread by starting the draw-off motor 58. At the same instant of time, the coil drive motor 50 also was set to rotate in forward direction. At the time 9, the thread carrier 55 is returned to the starting position thereof. At the time 9, the drawing roller 57 is again lifted from the delivery roller 54.

In order to be able to wind up the released thread loop quickly, at the time 9.6, the coil drive motor 50 is set to a somewhat increased winding speed. At the time 9.6, the device 67 for returning the joined thread back to the friction spinning unit and into the normal spinning position is started. The transfer roller 70 located on the device 67 swings towards the thread guide 22. Thereafter, the device 47 is taken out of the operation by swinging back again. This takes place at the time 11. Prior thereto, the arrested coil frame 25 was released (by non-illustrated means , so that the take-up coil 23 only remains in contact with the drive roller 48. After the drive roller 48 has swung out of the way, the coil 23 lies again on the winding roller 24. The thread thus arrives in the region of the thread guide 22, so that it is seized by the thread guide and pulled from the transfer roller 70 of the transfer device 67. The thread is accordingly delivered behind the draw-off roller 19, and lies against the thread monitor 20. This causes the thread monitor to change from the thread break setting thereof and to reactivate the electro-magnetic clutch 8 of the fiber feed device B. This occurs at the instant of time 10.5. Simultaneously, the coil drive motor 50 is initially brought up to the normal winding speed, and is finally switched off at the time 12. By actuating the device 59, the draw-off roller 19 is brought into contact again with the thread and the draw-off shaft 18 at the time 11.5. The device 64 which is not required at this point is restored to the starting position thereof at the time 11. Also, the device 67 which is no longer required is restored to its starting position at the time 11, which it has reached at the time 12. At the time 12, the delivery roller 54 is also rendered inoperative. Simultaneously, the motor 65 is switched off.

At the same time, the next travel cycle of the thread joining device 36" can be initiated by switching on the travel motor 46.

In the second embodiment of the invention according to FIG. 7, the device, which is identified as a whole by reference numeral 121, for controlling the movable parts forming the friction surfaces, of the friction spinning device, in this case the sieve drums 10 and 10', is differently constructed than in the first embodiment.

FIG. 7 is a fragmentary sectional view of the same friction spinning unit which was previously illustrated in FIG. 5 and which was described hereinabove in detail with regards to the first embodiment. The description will accordingly not be repeated here. At the right-hand side of FIG. 7, a fragmentary view of a thread joining device 36" is presented which, with a few exceptions which will be explained hereinafter, is of similar construction to that of the thread joining device 36 in the first embodiment. FIG. 7 shows only those parts which are not provided in the first embodiment of the invention.

During the start-up operation and the thread joining operation, respectively, the device 121 can be coupled to the drive arrangement 29' of the sieve drums, and can thereby directly take over the drive of the sieve drums. This makes it possible to rotate the sieve drums as slowly as desired for cleaning purposes so that all of the openings of the sieve drums can be thoroughly cleaned by blowing air through them in a direction opposite to the normal suction direction. The device 121 makes it also possible to rotate the sieve drums in reverse, so that the later-introduced thread end can be twisted open opposite the thread twist thereof, so that it binds better with the fibers. During the start or run-up after a successful thread connection and after the thread joining operation has taken place, respectively, a prescribed run-up characteristic can be set by means of the device 121. After the run-up operation has been completed, when the operational speed of the sieve drums has been reached, the drive device 29' of the friction spinning unit, of the type described in the first embodiment, can again be activated and take over the drive function.

The device 121 has a friction roller 122 which is rotatably supported on a swinging suspended arm 123. The arm 123 articulates with two links 124 and 125. By means of a non-illustrated transmission disposed in the interior of the thread joining device 36" and controllable by a program, the pivot axis 126 of the arm 124 can be so rotated that the arm 124 can move from the operating position thereof shown in FIG. 7 into a rest position identified by the reference character 124'.

The friction roller 122, in the operating position thereof shown in FIG. 7, engages the pulley 28 of the sieve drum 10 or, more precisely expressed, is in contact with the belt 11 which is wrapped around the pulley 28.

The friction roller 122 is operatively connected with the drive motor 135 of the drum via a bevel gear drive 127, gears 128 to 131 and toothed belts 132 to 134.

In the rest position, the arm 123 is swung back so far that the friction roller 122 is completely outside of the friction spinning unit, and cannot obstruct the travel of the thread joining device 36".

Figure 8:
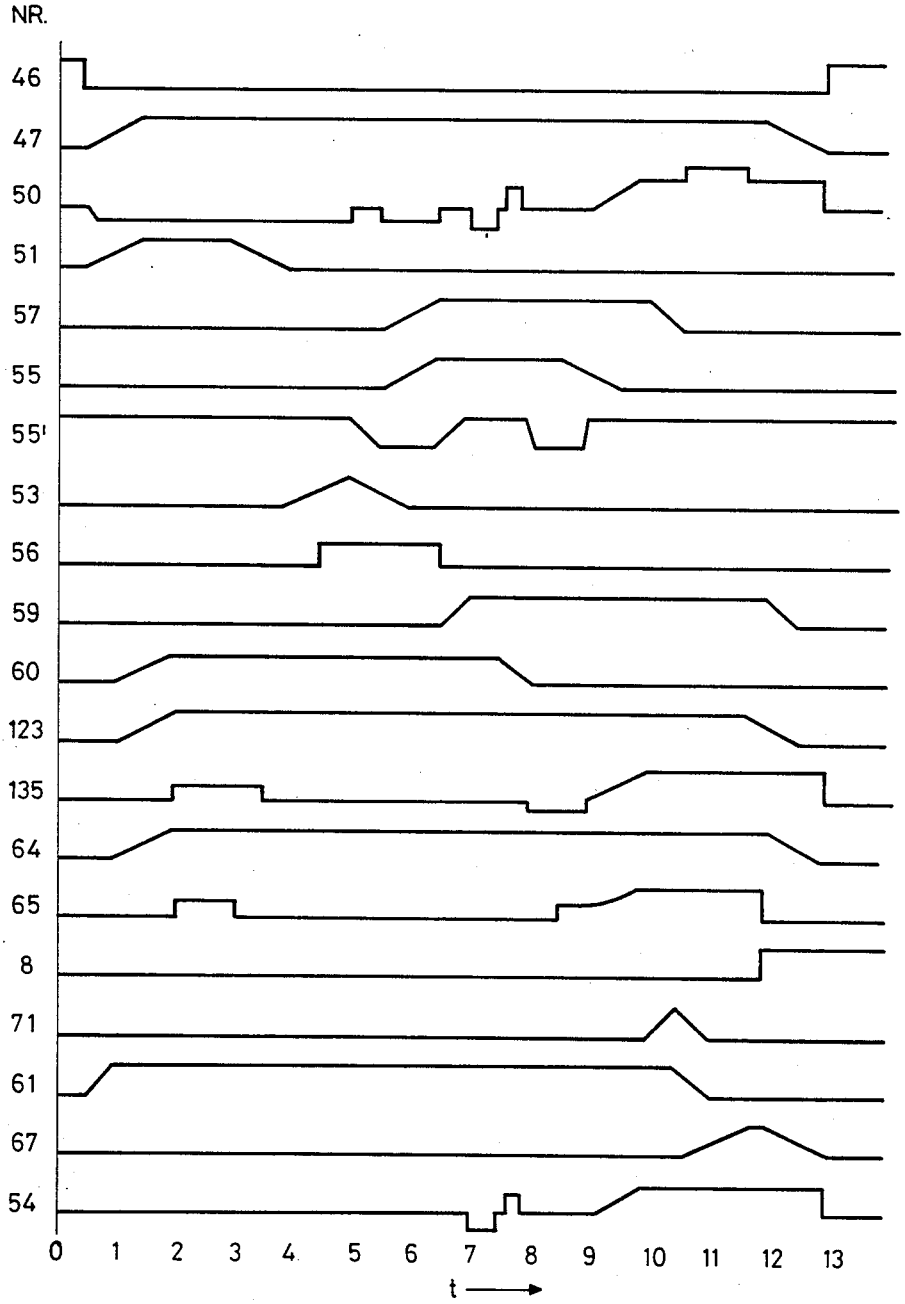
FIG. 8 is a motion diagram depicting the operation of the automatic thread joining device of FIG. 7.

The operation of the friction spinning unit according to FIG. 5 and FIG. 7 will now be explained for the second embodiment with the aid of the motion diagram of FIG. 8.

When the thread joining device 36" arrives at a friction spinning unit having a thread monitor which has signaled a thread break, a signal generator transmits the thread-break signal to a signal receiver at the thread joining device 36". A joining program is then initiated thereat, at the beginning of which, at the time 0.5, the travel mechanism motor is switched off. This is a prerequisite for the thread joining device 36 to proceed into the joining position. At the same time, the device 47 is started which, at the time 1.5 moves the drive roller 48 against or into contact with the coil 23. Also, at the time 0.5, the thread suction device 51 is started, the suction nozzle end 51' of which is in the vicinity of the surface of coil 23 at the time 1.5. The coil drive motor 50 rotates in the reverse direction at a speed suitable for searching for the thread end. The motor 50 is switched on at the time 0.8. At the time 1.0, the device 60 for operating the directional valve 37 is switched on. The switching-over of the directional valve 37 is completed at the time 2. However, as an alternate procedure thereto, the directional valve can also be switched over even before the arrival of the thread joining device 36. At the instant of time 1.0, also the device 64 for controlling the fiber feed device B is set into operation. This is effected by swinging the lever 100 in the direction of the curved arrow 100', as shown in FIG. 5, until the slip-on clutch 66 is pushed onto the end of shaft 2'. The clutching operation is terminated at the time 2. Prior to this, at the time 0.5, by actuating the device 61, the drive 29' is disengaged from the tangential belt 12. At the instant of time 1, the arm 123 is moved to the position shown in FIG. 7, so that the friction roller 122 contacts the belt 11 which is wrapped around the pulley 28, which is accomplished at the instant of time 2. At the same instant, the motor 65 and the drum drive motor 135 are switched on.

At the instant of time 2, the device 47 is in operation so as to revolve the take-up coil 23 in a direction opposite to the direction in which the thread is wound up thereon. Simultaneously, the thread suction device 51 is in operation to seek out the thread end of the surface of the coil 23, and pick it up by suction. The device 60 has switched over the directional valve 37, so that also the joining suction device 27 is in operation, and the two sieve drums 10 and 10' and the wedge or nip region are purged or cleaned of remainders of thread and fibers. The motor 65 is switched off again at the time 3.

Because the fiber-loosening roller 4 continues to rotate, fibers are fed through the fiber supply channel 9 into the spinning wedge 10" for a short time interval. However, the fibers have no place to accumulate, and are again removed by the suction device 27. This brief infeed of fibers has only the purpose of forming a whisker-like fiber accumulation having a specific combed-out condition. The subsequent joining operation is facilitated and improved. The sieve drum can be stopped by the thread monitor 20 even beforehand. Up to the time 3.5, the drum drive motor 135 then drives the sieve drums slowly in order to achieve an effective purging or cleansing.

At the time 3, the thread suction device 51 is again swung back to the starting position shown in FIG. 5. The swinging movement is completed at the time 4. The thread end is then positioned in the suction nozzle orifice 51'. At the time 4, the device D for making the thread ready is started, the insertion device 53 being swung from the position 53' thereof into the position thereof shown in FIG. 5. This swinging movement is completed at the time 5. The insertion device 53 entrains the thread loop 17', inserts the thread into the grippers 55' of the thread carrier 55 and, at the same time, brings the thread into contact with the grinding stone 56. At the time 5.0, the grippers 55' are closed in order to grip the thread. At the time 6.5 the grippers 55 are opened again. The grinding stone 56 is switched on already, namely at the time 4.5, and is switched off again at the time 6. The grinding stone 56 has its own drive motor which is not shown in FIG. 5. The grinding stone 56 severs the thread, and prepares the new thread end, by grinding, for the subsequent joining operation. The coil drive motor 50 is switched off at the time 5. At the same time, the thread insertion device 53 is returned to the position 53". It has reached this position again at the time 6. The thread carrier 55, the grippers 55' of which have received the thread, is started at the time 5.5. Simultaneously, the coil drive motor 50 is also turned on again, in order to supply the length of thread required for the swinging movement of the thread carrier 55. The thread carrier 55 swings into the thread suction region E, which it reaches at the instant of time 6.5. At the time 5.5, the drawing roller 57 is also pressed against the delivery roller 54 by the swing of arm 57'. In this regard, the thread is clamped between the drawing roller 57 and the delivery roller 54. At the time instant 6.5, the device 59 is activated in order to disable or render inoperative the thread drawing or take-up device 18, 19 of the friction spinning unit. The take-up roller 19 thus lifts itself up from the take-up shaft 18. The coil drive motor 50 keeps running until the instant of time 6.5, and is then switched off. It is again switched on at the time 7, and switched off anew at the time 7.5. Because the grippers 55' of the thread carrier 55 open at the time 6.5, the thread end can be sucked in between the sieve drums, and down into the suction device 27.

The reverse-running coil drive motor 50 supplies the required length of thread required for this purpose.

At the instant of time 7, the delivery roller 54 is switched on for return delivery of the thread by actuating the draw-off motor 58 until the instant of time 7.5. The same applies for the coil drive motor 50. Thereafter, the delivery roller 54 and the coil drive motor 50 are switched on only briefly to draw off the thread from the coil, so that the thread end which initially reached to the thread suction device 27, is then drawn back so far that it lies in the spinning wedge or nip 10'', ready for the joining operation. At the time 7.5, the device 60 is reset, whereby the directional valve 37 is switched over. The suction device C is thereby activated, and the joining suction device 27 is turned off.

From the time 8 to the time 9, the drum drive motor 135 rotates in reverse, so that the thread end lying in the spinning wedge 10'' loses its twist, and its fibers are roughed up or disentangled. During the same time, the grippers 55' close in order to limit the loosening or releasing of the twist lengthwise.

At the time 8.5, the infeed of fibers is started by switching on the motor 65. Run-up of the fiber infeed lasts only until the time 10. At the time 9, the drive drum motor 135 starts the run-up of the sieve drums which is coordinated with the run-up of the motor 65 and the motor 58, so that also, in the joining operation, twist and draft or stretch of the thread correspond to prescribed values. At the time 10, the drawing roller 57 is lifted from the delivery roller 54 again.

The run-up after the thread joining has occurred is terminated approximately at the instant of time 10. The run-up is controlled by the signals of the reflection light barrier or gate 62.

After all of the drives have reached the operational rotary speeds thereof, the throw-off device 71 is actuated at the time 10, and is returned again to its starting position at the time 11. The throw-off device 71 throws off the thread loop 17 from the delivery roller 54. Prior to this, at the time 9, the delivery roller 54 was made ready to draw-off the thread by starting the draw-off motor 58. At the same instant of time, the coil drive motor 50 also was set to rotate in forward direction. At the time 10.5, the device 61 releases the drive 29' again. The drum drive motor 135 which was set for forward drive at the time 9, has then finished the run-up phase thereof In order to be able to wind up the released thread loop quickly, at the time 10.6, the coil drive motor 50 is set to a somewhat increased winding speed. At the same time, the device 67 for returning the joined thread break back to the friction spinning unit and into the normal spinning position is started. The transfer roller 70 located at the device 67 swings towards the thread guide 22.

Thereafter, the device 47 is taken out of the operation by swinging back again. This takes place at the time 12. Prior thereto, the arrested coil frame 25 was released by non-illustrated means, so that the take-up coil 23 only remains in contact with the drive roller 48. After the drive roller 48 has swung out of the way, the coil 23 lies again on the winding roller 24. The thread thus arrives in the region of the thread guide 22, so that it is seized by the thread guide and pulled from the transfer roller 70 of the transfer device 67. The thread is accordingly delivered behind the draw-off roller 19, and lies against the thread monitor 20. This causes the thread monitor to change from thread break setting thereof, and to re-activate the electro-magnetic clutch 8 of the fiber feeding device B. This occurs at the instant of time 12. At the time 11.7, the coil drive motor 50 is first brought up to its normal winding speed, and is then switched off at the time 13. By actuating the device 59, at the time 12, the draw-off roller 19 is brought into contact again with the thread and the draw-off shaft 18. The device 64 which is not required at this point is taken out of service at the time 12. Also, the device 67, which is not required any longer, is restored to the starting position thereof at the time 12, which it has reached at the time 13. At the time 13, the delivery roller 54 is also rendered inoperative. At the time 12, the motor 65 is switched off. Because the drive 29' is already in operation and drives the sieve drums, the arm 123 can be moved into the rest position thereof at the time 11.5, and, at the time 13 the drum drive motor 135 can be switched off.

At the same time, the next travel cycle of the thread joining device 36'' can be initiated by switching on the travel motor 46.

As mentioned hereinbefore, the invention is not limited to the illustrated and described specific embodiments which are presented merely by way of example. The switching-over of the directional valve 37 for purging or cleansing the friction surfaces, for example, in accordance with another possible version of the invention, can at the latest be performed after the movement of the friction surfaces has stopped. In such a case, the thread joining device finds the directional valve already switched-over, when it gets there, and only has to switch it back for spinning operation later on. The first switch-over may also be initiated by the thread monitor responding to a thread break, or may be initiated by the thread cleaner.

The friction spinning units of the exemplary embodiments have common drives, such as, for example, shafts extending through the machine, or tangential belts. As an alternative, however, individual drives may be provided for each of the spinning units.

The foregoing is a description corresponding in substance to German Application No. P 33 17 361.3, filed May 13, 1983, the International priority of which is being claimed for the instant application, and which is hereby made part of this application. Any material discrepancies between the foregoing specification and the aforementioned corresponding German application are to be resolved in favor of the latter.

We claim:

1. Method of starting the operation of a friction spinning unit having friction surfaces displaceable in opposite directions and forming a spinning wedge, the spinning unit further having a fiber infeeding device, a thread take-up device for drawing a thread longitudinally through the spinning wedge, and at least one suction device acting upon the spinning wedge, at least one of the friction surfaces being formed by a sieve drum, the suction device having a suction nozzle acting upon the spinning wedge by sucking air through the wall of the sieve drum, which comprises:

(a) stopping the fiber infeed, and stopping the displacement of the friction surfaces;

(b) stopping the flow of suction air from the spinning wedge through the wall of the sieve drum into the suction nozzle;

(c) introducing into the spinning wedge through the wall of the sieve drum a suction air flow in a direction opposing the direction in which the thread is being drawn, and guiding the air flow out of the suction nozzle through the wall of the sieve drum and in a direction opposing the direction in which the thread is being drawn, along the spinning wedge, and out of the spinning wedge;

(d) after a given effective duration of the suction air flow, introducing a thread end into the spinning wedge in a direction opposing normal thread drawing direction;

(e) again applying a suction air flow from the interior of the spinning wedge through the wall of the sieve drum into the suction nozzle;

(f) restarting the fiber infeed, and displacing the friction surfaces with increasing speed in opposing directions;

(g) resuming the thread drawing, and increasing the thread drawing until normal spinning conditions are reached; and (h) at the latest at this juncture, again stopping the suction air flow directed against the thread drawing direction.

2. Method according to claim 1, which includes, after stopping the flow of suction air, reversing the direction of the air flowing through the wall of the sieve drum.

3. Method according to claim 1, which includes, after beginning the drawing of the thread, mutually coordinating the fiber infeed, the displacement of the friction surfaces, and the rate at which the thread is drawn, and increasing the infeed, the displacement and the rate, until normal spinning conditions are reached.

4. Method according to claim 1, which includes, after inserting the thread into the spinning wedge, displacing the friction surfaces in a direction opposing the direction used during the normal spinning operation, in order to remove thread twist from the thread end.

5. Method according to claim 4, which includes holding the thread fixed outside of the spinning wedge at least as long as necessary to remove the twist from the thread end.

6. Method according to claim 1, which includes shutting off the suction nozzle from its air supply and venting the suction nozzle to the surrounding air.

7. Method according to claim 1 which includes shutting off the suction nozzle from its air supply and connecting the suction nozzle to a source of compressed air.

8. Device for performing a method of starting the operation of a friction spinning unit having friction surfaces displaceable in opposing directions and forming a spinning wedge, the spinning unit further having a fiber device, a thread take-up device for drawing the thread longitudinally through the spinning wedge, and at least one suction device acting upon the spinning wedge, at least one of the friction surfaces being formed by a sieve drum, the suction device having a suction nozzle acting upon the spinning wedge by sucking air through the wall of the sieve drum, comprising a pneumatic device having means for generating an air flow and for directing the air flow along the spinning wedge opposite the thread drawing direction, and out of the spinning wedge.

9. Device according to claim 8, wherein the one suction device and said pneumatic device have a common blocking device for alternatively providing suction air to the one suction device and said pneumatic device and for preventing simultaneous application of suction air to the one suction device and said pneumatic device.

10. Device according to claim 9, wherein said blocking device is constructed as a switchable directional valve, said directional valve being alternatively switchable for connecting the one suction device and the pneumatic device, respectively, to a common source of suction air.

11. Device according to claim 9, wherein said blocking device is constructed as a switchable directional valve, said directional valve being alternatively switchable for connecting the one suction device and the pneumatic device, respectively, to the surrounding air.

12. Device according to claim 9, wherein said blocking device is constructed as a switchable directional valve, said directional valve being alternatively switchable for connecting the one suction device and the pneumatic device, respectively, to a common compressed-air source.

13. Device according to claim 8, wherein the sieve-drum friction surfaces are movable parts of the friction spinning unit forming the spinning wedge, and including a cover for said movable parts, said cover having air suction means of a thread joining suction device located at a side opposite the thread drawing side.

14. Device according to claim 13, wherein said air suction means are disposed at a fiber supply channel of the fiber infeed device, said fiber supply channel extending through said cover.

15. Device according to claim 8, including a program-controlled automatic thread joining device operatively combined with the friction spinning unit.

16. Device according to claim 15, wherein the automatic thread joining device is constructed as a movable device for servicing a plurality of friction spinning units of a friction spinning machine sequentially.

17. Device according to claim 15, wherein the automatic thread joining device comprises:

(a) means for driving the take-up coil in a direction opposing thread winding direction and in direction of winding of the thread;

(b) means for sucking-in the thread movable towards the surface of the take-up coil, and back again;

(c) means for making-ready a thread end taken from the take-up coil for the thread joining operation;

(d) means for transporting the made-ready thread end to a thread suction location within working range of the thread joining suction device;

(e) means for disabling and re-enabling the thread drawing device of the friction spinning unit;

(f) means for actuating the blocking means, and the directional valve, respectively, of the one suction device and the pneumatic device;

(g) means for starting the operation of the sieve drums of the friction spinning unit forming the friction surfaces;

(h) means for controlling the fiber infeed device during the thread joining operation; and (i) means for returning the joined thread to the friction spinning unit, and into the normal spinning position.

18. Device according to claim 17, wherein the automatic thread joining device has means for controlling the sieve drums of the friction spinning unit during the joining operation.

19. Device according to claim 17, wherein the automatic thread joining device has a grinding device for readying and sharpening the end of the thread.

20. Device according to claim 8, wherein the friction spinning unit has a shut-off device cooperatively associated with a thread monitor or thread cleaner, for stopping fiber infeed and rotation of the take-up coil.

21. Device according to claim 8, wherein the friction spinning unit has a device cooperatively associated with a thread monitor or thread-cleaner for stopping said sieve drums forming said friction surfaces.

22. Device according to claim 8, including means for controlling said sieve drums forming said friction surfaces, said controlling means being constructed so as to drive said sieve drums alternatively in forward and reverse direction.

23. Device according to claim 8, wherein the friction spinning unit has means for holding the thread in a fixed position outside the spinning wedge during the time when the thread twist is removed from the thread end.

24. Device according to claim 8 wherein the thread joining device has means for holding the thread in a fixed position outside the spinning wedge during the time when the thread twist is removed from the thread end.

25. Device according to claim 8, wherein the pneumatic device is a thread-joining suction device.

* * * * *